United States Patent [19]

Peters et al.

[11] 4,412,551

[45] Nov. 1, 1983

[54] APPARATUS FOR CLEANING HYDRAULIC FLUID SYSTEM

[76] Inventors: LeRoy W. Peters, 155 Canal St., #17; Walter E. Moore, 647 Francisco Blvd., both of San Rafael, Calif. 94901

[21] Appl. No.: 337,562

[22] Filed: Jan. 7, 1982

[51] Int. Cl.[3] ..... B08B 9/00

[52] U.S. Cl. ..... 134/104; 134/169 A

[58] Field of Search ..... 134/104, 166 R, 169 A

[56] References Cited

U.S. PATENT DOCUMENTS

| | | | |
|---|---|---|---|
| 2,525,978 | 10/1950 | Vallerie | 134/104 X |
| 3,584,633 | 6/1971 | Arrigo | 134/104 |
| 3,601,135 | 8/1971 | Marlow et al. | 134/166 R X |
| 4,086,930 | 5/1978 | Hiss | 134/169 A X |

*Primary Examiner*—Robert L. Bleutge

*Attorney, Agent, or Firm*—Townsend and Townsend

[57] ABSTRACT

An apparatus for cleaning hydraulic fluid residue from a system such as an automatic transmission cooling system of a vehicle includes a solvent dispensing reservoir, a solvent recovery reservoir, and a pneumatically controlled check valve coupling the solvent dispensing reservoir and solvent recovery reservoir. The check valve responds to pneumatic pressure to block flow from the solvent recovery reservoir into the solvent dispensing reservoir and to pressurize the solvent reservoir to propel solvent into the system to be cleaned. In the absence of pneumatic pressure, recycled solvent in the solvent recovery reservoir can flow into the solvent dispensing reservoir for reuse. The apparatus is preferably for cleaning automotive automatic transmission cooling systems of accumulated "varnish" and other debris.

6 Claims, 2 Drawing Figures

30
32
46
34
36
44
40
10
38
22
14
24
48
54
52
50
18
16
20
56
58
12
28
60
62
26

APPARATUS FOR CLEANING HYDRAULIC FLUID SYSTEM

BACKGROUND OF THE INVENTION

Field of Invention

This invention relates to a cleaning apparatus for use in flushing fluid systems, particularly hydraulic fluid systems such as the cooling systems for automatic transmissions of automobiles.

The cooling systems of automatic transmissions, such as those used in automobiles, typically accumulate a residue of lacquer. This residue occurs on the interior portions of the transmission cooling surfaces. The lacquer degrades cooling performance in that it retards the desired heat transfer of the cooling system. This limits the life of the transmission in that the unit operates at elevated temperatures.

In the past, when such transmissions have been repaired maintenance procedures have called for the pouring of liquid solvents into the system under repair. Such liquid solvents are utilized to dissolve and dislodge the formed lacquers and other accumulated waste out of the cooling system when it is under repair.

Some prior art devices have used positive displacement mechanical pumps to propel solvent through the transmission cooling system. Solvent has no lubricating value and tends to dislodge lacquer and other accumulated waste residues in the system. The combination of lacquer and abrasive residues results in rapid pump wear on such positive displacement pumping systems.

What is needed is an apparatus which can be used to flush hydraulic transmission cooling systems with solvent through the cooling system without pump wear and additionally can be relatively self-contained and easy to use.

SUMMARY OF THE INVENTION

An apparatus for cleaning hydraulic fluid from a cooling system includes a solvent dispensing reservoir, a solvent recovery reservoir, and a pneumatically controlled check valve coupling the solvent dispensing reservoir and solvent recovery reservoir. The check valve responds to pneumatic pressure to block flow from the solvent recovery reservoir into the solvent dispensing reservoir and to pressurize the solvent reservoir to propel solvent into the system to be cleaned. In the absence of pneumatic pressure, recycled solvent in the solvent recovery reservoir can flow into the solvent dispensing reservoir for reuse. The apparatus is primarily for cleaning automotive automatic transmissions cooling systems.

One of the objects of the invention is to conveniently supply solvent under pressure to flush a hydraulic system such as an automatic transmission of an automobile. For this purpose, means are provided to couple the apparatus according to the invention to an air supply.

A further object of the invention is to recover relatively expensive solvent after use in flushing a system wherein there is means for recirculation of the solvent.

Other objects and advantages of the invention will be apparent upon reference to the following detailed description taken in conjunction with the specific embodiments.

DETAILED DESCRIPTION OF SPECIFIC EMBODIMENTS

Figure 1:
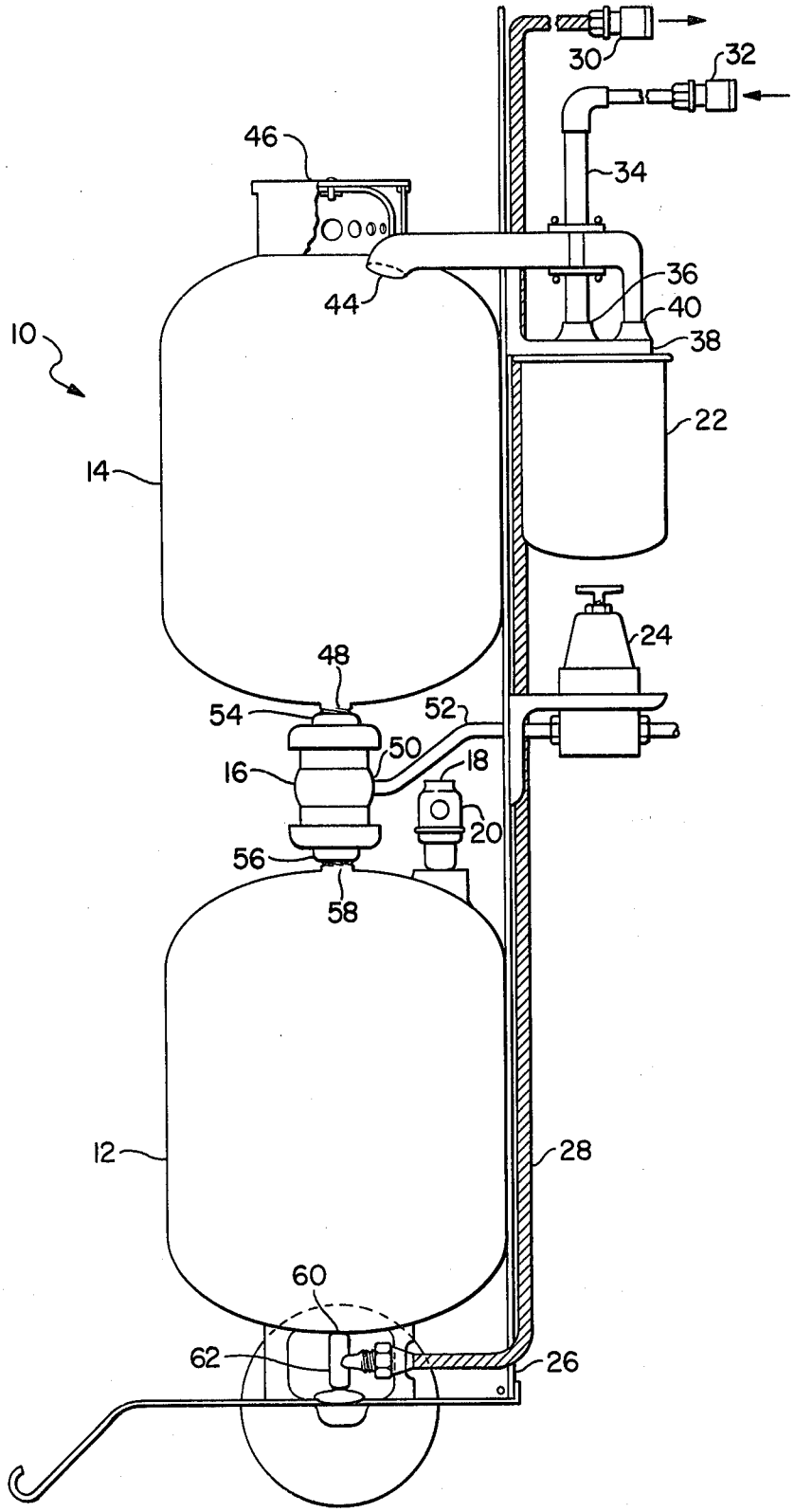
FIG. 1 is a side elevational view of an apparatus according to the invention.

Turning to FIG. 1 there is shown a flushing apparatus 10 comprising a first reservoir or solvent dispensing tank 12, a second reservoir or solvent recovery tank 14, a pneumatically actuated check valve 16, a vent 18 with a biased check valve 20 having two opposing orifices, an oil filter 22 and a pressure regulator 24 mounted to a frame 26, such as a hand truck.

A fluid outlet line 28 is adapted to be coupled to the hydraulic fluid inlet of an automatic transmission cooling system or the like (not shown) through an appropriate coupler 30. A fluid return from an automatic transmission cooler outlet is coupled to an appropriate coupler 32 which in turn is coupled to a fluid inlet line 34 connected to the fluid inlet 36 of a filter mount 38 for the filter 22. The filter 22 is a standard automotive twist-on filter having internal paper elements. A fluid outlet 40 of the filter mount 38 is coupled to a tube 42 into a fluid inlet 44 of the solvent recovery tank 14.

The solvent recovery tank 14 is a reservoir vented to the atmosphere through a safety vent 46 at its normally highest point of having an outlet 48 for draining at its normally lowest point.

The outlet 48 is coupled to the pneumatically actuated check valve 16 which has in addition an air inlet 50 coupled to an air inlet line 52 in communication with the pressure regulator 24. The pressure regulator 24 is generally set at about 5 PSI and is adapted to be coupled to an air supply (not shown). The air supply is valved to control the operation of the pneumatically actuated check valve 16.

Solvent is communicated between an inlet 54 of the pneumatically actuated check valve 16 and an outlet 56, which in turn is in fluid communication with an inlet 58 of the solvent dispensing tank 12 near the normal top end of the tank. The solvent dispensing tank 12 has an outlet 60 at its normally lowest end coupled to the fluid outlet line 28. The fluid outlet line 28 may be valved by a spigot 62 or by a check valve in the coupling 30 of the outlet line.

The vent 18 of the solvent dispensing tank 12 is mounted at or near the normally top end so that gas in the tank 12 can be evacuated. The biased check valve 20 is normally biased open by a spring or gravity so that gas may freely vent to the atmosphere. The biased check valve 20 may be a type AC CV 5800 PCV valve normally used for automotive applications. The valve 20 closes and seals whenever the pressure differential across the valve is substantially greater than ambient pressure. However, it opens to the atmosphere whenever the pressure differential across the valve is not substantial, that is, not greater than the bias pressure, to allow relatively low pressure venting of the interior of the solvent dispensing tank 12 to the atmosphere. This assures that solvent in the solvent recovery tank 14 can flow freely into the solvent dispensing tank 12 in a manner displacing gas at ambient pressure in the solvent dispensing tank 12. However, the check valve 20 seals whenever the solvent dispensing tank 12 is pressurized so that solvent can be propelled through its fluid outlet 60.

Figure 2:
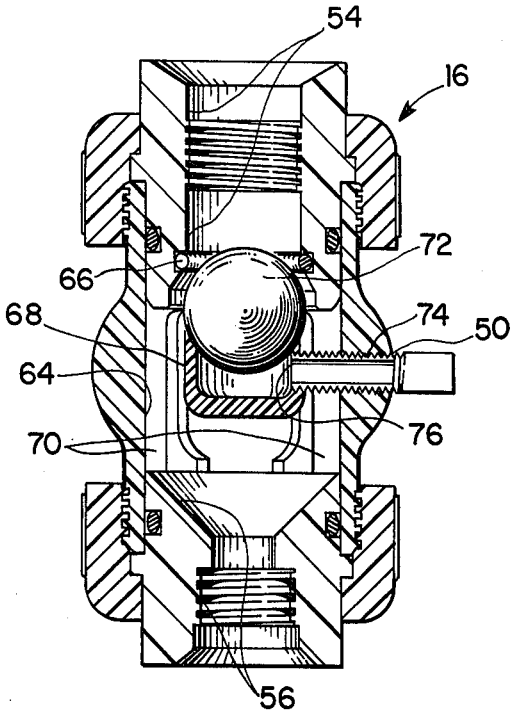
FIG. 2 is a side cross-sectional view of a pneumatically actuated check valve according to the invention.

Turning to FIG. 2, the pneumatically actuated check valve 16 includes a valve gating chamber 64 having at one end a valve seat 66, such as an O-ring circumscribing the inlet 54. A cup 68 is disposed at the opposing end of the gating chamber 64 with open passages 70 around the cup 68 to the outlet 56. A sphere 72 or like gate is operative to move between the valve seat 66 and the cup 68 in the gating chamber 64. The sphere 72 is biased, typically by gravity or fluid pressure, to the cup 68. The air inlet 50 is coupled to an air passage 74 having an opening 76 interior of the cup 68 so that air or like pneumatically active gases can be introduced into the chamber 64 with the cup 68 as the outlet nozzle.

Pneumatically actuated check valve 16 operates as follows: Air directed into the air inlet 50 introduces pressurized air or the like into the cup 68 through the passage 76 forcing the sphere 72 from its normal rest position on the cup and against the valve seat 66. At the same time, the air is vented through the passages 70 to the outlet 56 for use in pressurizing the solvent dispensing tank 12, which in turn urges the vent-mounted biased check valve 20 to a closed position. The liquid in the pressurized solvent dispensing tank 12 is then useable at will through the valved outlet line 28.

When the air pressure is disconnected at the air inlet 50, as for example when the solvent supply in the solvent dispensing tank 12 has been exhausted, the sphere 72 moves to its rest position in the cup 68, the check valve 20 opens, and liquid in the solvent recovery tank 14 is allowed to drain into the solvent dispensing tank 12 for reuse or disposal.

The invention has now been explained with respect to specific embodiments. Other embodiments will be apparent to those of ordinary skill in the art. It is therefore not intended that this invention be limited except as indicated by the appended claims.

We claim:

1. An apparatus for flushing solvent through a machine such as a hydraulic cooling system having a first fluid inlet and a first fluid outlet, said apparatus comprising:

a first reservoir for supplying solvent to said first fluid inlet, said first reservoir being pressurizable and having a second fluid inlet and a second fluid outlet, said second fluid outlet for coupling to said first fluid inlet;

a second reservoir for recovering solvent from said fluid outlet, said second reservoir having a third fluid inlet and a third fluid outlet; and means having a fourth fluid inlet coupled to said third fluid outlet and a fourth fluid outlet coupled to said fluid inlet for communicating solvent from said second reservoir to said first reservoir and for pressurizing said first reservoir to propel solvent through said second fluid outlet.

2. The apparatus according to claim 1 wherein said solvent communicating and reservoir pressurizing means comprises a first check valve, said first check valve being controllable by pneumatic pressure and having a pneumatic inlet to a valve gating chamber, said first check valve being operative in a first position in the absence of pneumatic pressure input to permit solvent flow from said second reservoir to said first reservoir, and in a second position in the presence of pneumatic pressure to block solvent flow from said second reservoir to said first reservoir while diverting pneumatic flow into said first reservoir for pressurizing said first reservoir.

3. The apparatus according to claim 2 wherein said first check valve further includes a valve seat, a pneumatic nozzle, and a spherical valve gate, said gate being mounted to move within said gating chamber between said valve seat and said pneumatic nozzle, said valve seat being adjacent to and blocking said fourth fluid inlet, and said pneumatic nozzle being mounted adjacent to and not blocking said fourth fluid outlet, such that introduction of gas under pressure through said pneumatic inlet causes said gate to close against said seat and to direct gas under pressure through said fourth outlet, and further such that absence of pneumatic pressure permits flow of solvent through said check valve from said second reservoir to said first reservoir.

4. The apparatus according to claim 2 or 3 wherein said first reservoir further includes a second check valve having a first orifice in communication with said first reservoir and a second orifice in communication with ambient pressure, said second check valve being operative to seal said second orifice when pressure differential across said second check valve substantially exceeds ambient pressure and further operative to unseal said second orifice and permit said first reservoir to vent gas to ambient pressure when pressure differential across said second check valve does not substantially exceed ambient pressure.

5. The apparatus according to claim 1, 2 or 3 wherein said second reservoir is mounted normally above said first reservoir to allow gravity-aided flow from said second reservoir to said first reservoir, and wherein said second reservoir includes venting means for venting gas to ambient pressure.

6. The apparatus according to claim 1 or 5 further including fluid filter means coupled to said third fluid inlet for filtering fluid directed into said second reservoir from said first fluid outlet.

* * * * *